US009870862B2

(12) United States Patent
Wakade et al.

(10) Patent No.: US 9,870,862 B2
(45) Date of Patent: Jan. 16, 2018

(54) METHOD OF MAKING NON-RECTANGULAR MAGNETS

(71) Applicant: GM Global Technology Operations LLC, Detroit, MI (US)

(72) Inventors: Shekhar G. Wakade, Grand Blanc, MI (US); Yucong Wang, West Bloomfield, MI (US); Edward P. Becker, Brighton, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 700 days.

(21) Appl. No.: 13/868,468

(22) Filed: Apr. 23, 2013

(65) Prior Publication Data

US 2014/0314611 A1 Oct. 23, 2014

(51) Int. Cl.
*H01F 41/02* (2006.01)

(52) U.S. Cl.
CPC ..... *H01F 41/0246* (2013.01); *H01F 41/0266* (2013.01)

(58) Field of Classification Search
CPC ..... B22F 2999/00; B22F 3/08; B22F 3/087; H01F 1/0577; H01F 41/0246
See application file for complete search history.

(56) References Cited

U.S. PATENT DOCUMENTS 6,767,505 B2 * 7/2004 Witherspoon ..... B22F 3/087 419/45
7,155,804 B2 * 1/2007 Calico ..... H02K 1/14 29/596
7,744,812 B2 6/2010 Witherspoon et al.
7,847,461 B2 12/2010 Rahman et al.
8,206,516 B2 6/2012 Yoshimura et al.
9,224,526 B1 * 12/2015 Nagarathnam ..... H01F 1/0558
2005/0001499 A1 * 1/2005 Calico ..... H02K 15/03 310/156.08
2005/0057114 A1 3/2005 Calico
2010/0083498 A1 * 4/2010 Wakade ..... B22F 3/087 29/888.1
2012/0114515 A1 * 5/2012 Kaneko ..... B22F 1/0088 419/10
2013/0078369 A1 3/2013 Shoji et al.

FOREIGN PATENT DOCUMENTS

CN 1317384 A 10/2001
CN 102667978 A 9/2012
CN 102925757 A 2/2013
(Continued)

OTHER PUBLICATIONS

Machine translation of JP2006-278919 A, Oct. 2006.*
(Continued)

*Primary Examiner* — Xiaowei Su
(74) *Attorney, Agent, or Firm* — BrooksGroup

(57) ABSTRACT

A number of variations may include a method including providing a first powder comprising iron; compacting the first powder into a compacted powder product having a non-planar surface, wherein the compacting includes dynamic magnetic compaction or combustion driven compaction; and increasing the magnetic coercivity of at least one of the first powder or compact powder product.

11 Claims, 9 Drawing Sheets

(56) References Cited

FOREIGN PATENT DOCUMENTS

JP 2006278919 A * 10/2006
WO WO 2011043158 A1 * 4/2011 ..... B33F 1/0088

OTHER PUBLICATIONS

DMC Paper, Magnetic compaction process nears market, (MPR Feb. 2000).*
B.Chelluri,E Knoth Powder Forming Using Dynamic Magnetic Compaction, pp. 26-34 , IAP Research, Inc.,2763 Culver Avenue, Dayton, Ohio,USA 4th International Conference on High Speed Forming—2010.
How Neodymium Magnets Are Made www.ndfeb-info.com/neodymium_magnets_made.aspx. Copyright-e-Magnets UK 3 pages.
Chinese Office Action dated Feb. 2, 2016; Application No. 201410164545.6; Applicant:GM Global Technology Operations LLC.; 9 pages.

* cited by examiner

METHOD OF MAKING NON-RECTANGULAR MAGNETS

TECHNICAL FIELD

The field to which the disclosure generally relates to includes methods of making non-rectangular magnets and products which may be used in such methods.

BACKGROUND

Magnets may be utilized for a variety of application including, but not limited to, electric motors. Such magnets may be made by a variety of methods utilizing ferromagnetic powders.

SUMMARY OF ILLUSTRATIVE VARIATIONS OF THE DISCLOSURE

A number of variations may include a method comprising providing a first powder comprising iron; compacting the first powder into a product having a non-planer surface, wherein the compacting comprises dynamic magnetic compaction or combustion driven compaction; increasing the magnetic coercivity of at least one of the first powder or the compacted powder product.

Other illustrative variations will become apparent from the detailed description provided hereinafter. It should be understood that the detailed description and specific examples, while disclosing optional variations, are intended for purposes of illustration only and are not intended to limit the scope of the invention.

BRIEF DESCRIPTION OF THE DRAWINGS

Select examples of variations will become more fully understood from the detailed description and the accompanying drawings, wherein.

DETAILED DESCRIPTION OF ILLUSTRATIVE VARIATIONS

The following description of the variations is merely illustrative in nature and is in no way intended to limit the invention, its application, or uses.

A number of variations may include a method including providing a first powder which may include iron and other elements or components. The first powder may be compacted into a product at least a portion of which may include a non-planar surface, curved surface or arcuate shaped surface. The compacting of the first powder may be accomplished by an electromagnetic forming process such as, but not limited to dynamic magnetic compaction. In a number of other variations the compacting of the powder may be accomplished by a combustion driven compaction process. In a number of variations the method may include increasing the magnetic coercivity of at least one of the first powder or the compacted powder product.

Figure 1:
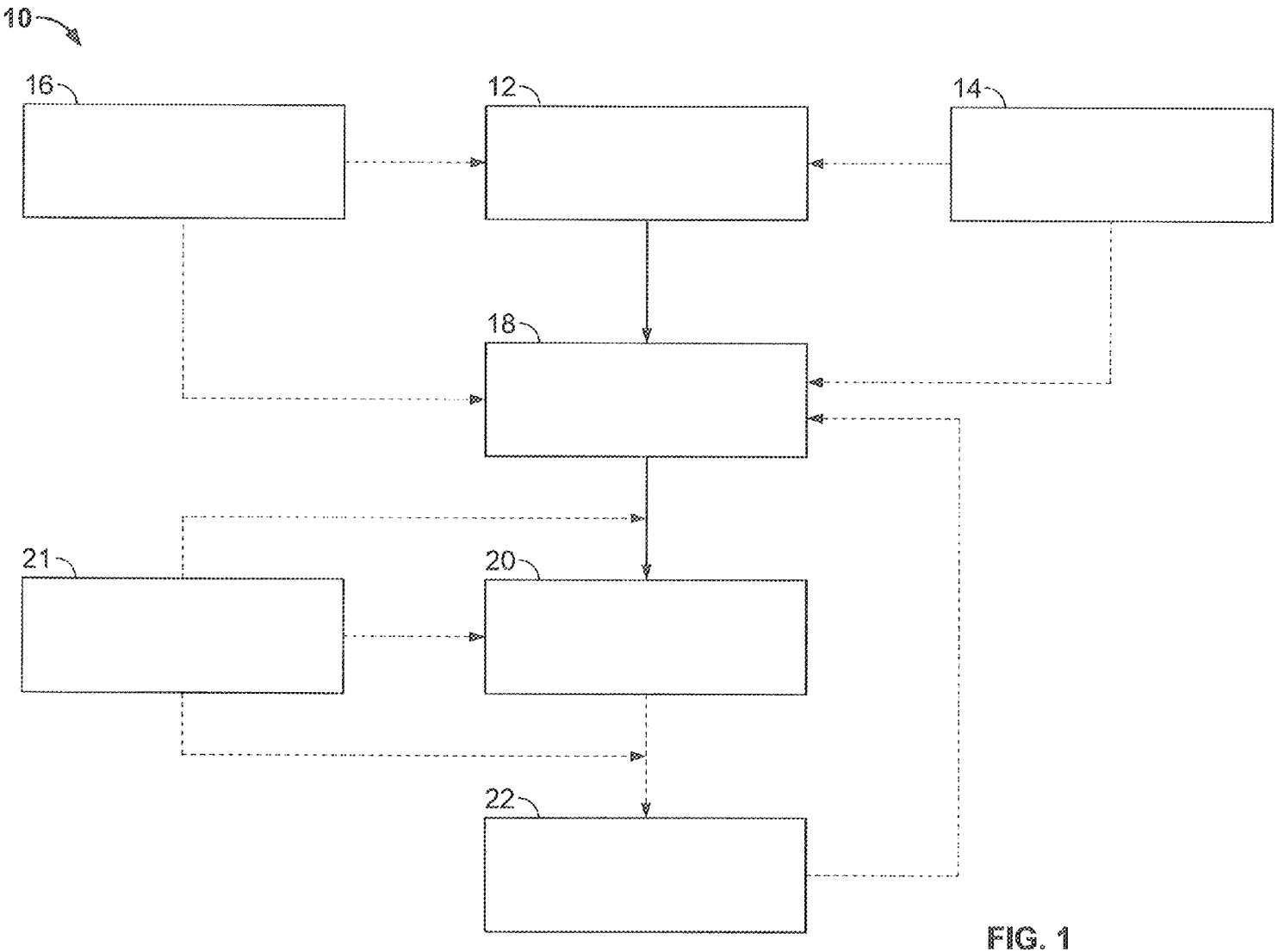
FIG. 1 is a process flow diagram including the acts of providing a first powder including iron and compacting the first powder according to a number of the variations.

FIG. 1 illustrates a number of variations. A number of variations may include a method including providing a first powder 12. The first powder may be provided in a magnetically aligned or unaligned state. In a number of variations, the method may include compacting 18 the first powder into a product having a non-planar surface, curved surface or arcuate shaped surface. In a number of variations, the method may include magnetically aligning 14 the powder prior to the compacting 18 or during the compaction process 18. In a number of variations, the method may include increasing the magnetic coercivity 16 of the first powder or of the compacted product. In a number of variations, the magnetic coercivity may be increased in the first powder by the addition of a material including Dy, such as, but not limited to Dy-Fe, Dy-Fe-B, Dy-Fe-Co-B, and Dy-Nd-Pr-Fe-Co-B in a powder or particulate form. In a number of variations, Dy may be added to Fe and other elements such as, but not limited to, Nd and B, which may be alloyed and the resultant alloy may be made into powder or particulate. In another variation increasing the magnetic coercivity of the compacted powder product may be accomplished by coating of a Dy source onto the compacted powdered product. In a number of variations, the method may include sintering the compacted powder product 20. In a number of variations, the compacted powder product 20 may be sintered at a temperature up to 1100 C. In a number of variations, the method may include chemically diffusing 21 Dy in the compacted powder product prior to sintering, as part of the sintering process, and/or after sintering. In another variation, it may not be necessary to sinter the powder compact due to the inherent strength of the compact. In such a situation, the compacted mass may be subjected to a heat treatment intended to diffuse Dy source material at a temperature that is lower than typical sintering temperature of base material. In such case the temperature range may be between 650 C to 950 C, depending upon the time element involved. For example, the diffusing of Dy in the compacted powder product or the sintered product may be accomplished by heat treating the same at a temperature ranging from about 650 C to about 950 C for about 1 hour to about 24 hours. A number of variations may include machining 22 the compacted powder product or the sintered product.

Figure 2:
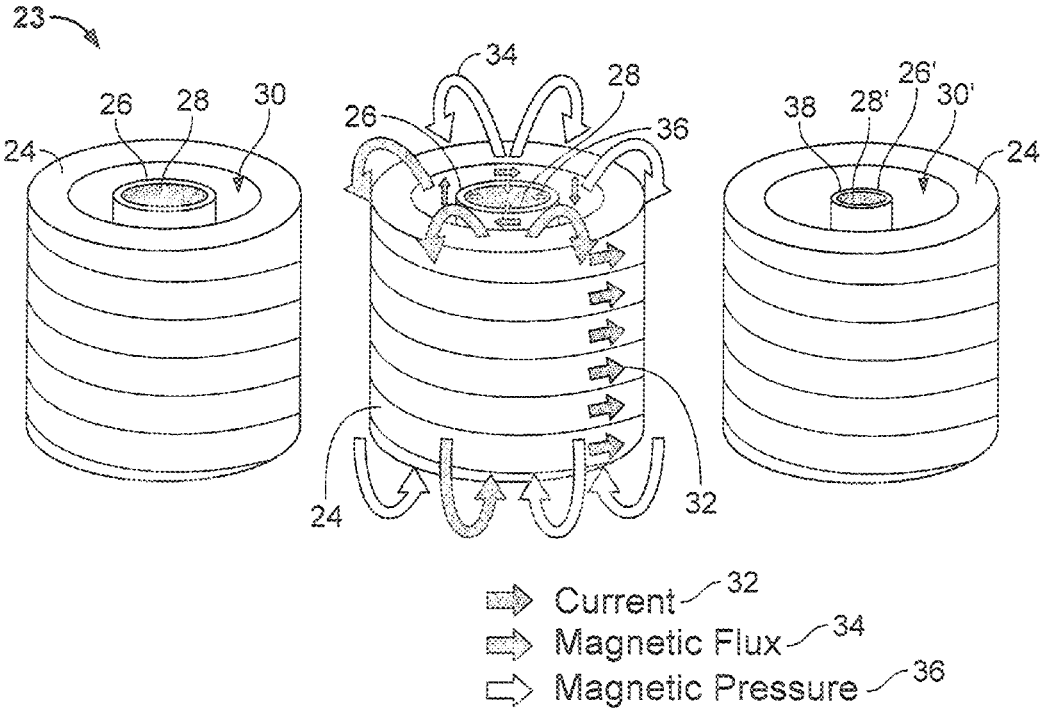
FIG. 2 is a schematic illustration of a dynamic magnetic compaction process useful in a number of variations.
Figure 3:
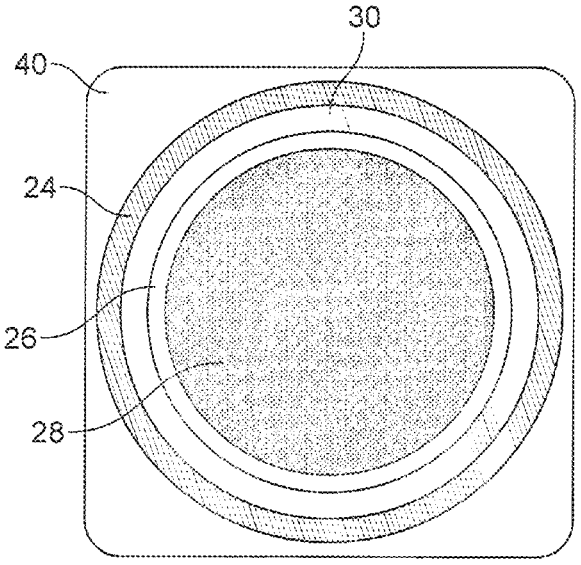
FIG. 3 is a plan view showing a containment shell, coil, container and powder useful in the process illustrated in FIG. 2.

FIG. 2 illustrates a number of variations. A number of variations may include a method utilizing a dynamic magnetic compaction process 23, which may utilize a coil 24 connected to a current source (not shown), an armature or casing or first container 26 having a ferromagnetic powder 28 therein. An annular space 30 may be provided between the first container 26 and the coil 24. A high intensity pulse current may be supplied to the coil 24. The first container 26 may be electrically conductive. As the coil 24 is pulsed with a high current to produce a magnetic field in the bore that, in turn, induces currents in the first container 26 when the container 26 is electrically conductive. The induced currents in the first container 26 also produce a magnetic field which interacts with the applied magnetic field from the coil 24 to produce an inwardly acting magnetic force that collapses the first container 26 and compacts the powder 28. In a number of variations, the powder 28 may be subjected to 2 GPa or more of pulsed pressures. The powder 28 may be pressed to a very high to full density via the transmitted impact energy wherein the entire compaction cycle may occur in less than one millisecond. The collapsed container 26' and the compacted powder 28' have a smaller cross-sectional area and overall volume than the original container 26 and powder 28. The annular space 30' between the collapsed container 26' and the coil 24 after the process is completed is larger than the annular space 30 before the process began. In FIG. 2 the arrows labeled 32 represent the current, the arrows labeled 34 represent the magnetic flex, and the arrows labeled 36 represent the magnetic pressure being applied to the powder 28. As shown in FIG. 3, a containment shell 40 may be placed around the coil 24 during the process.

Figure 4A:
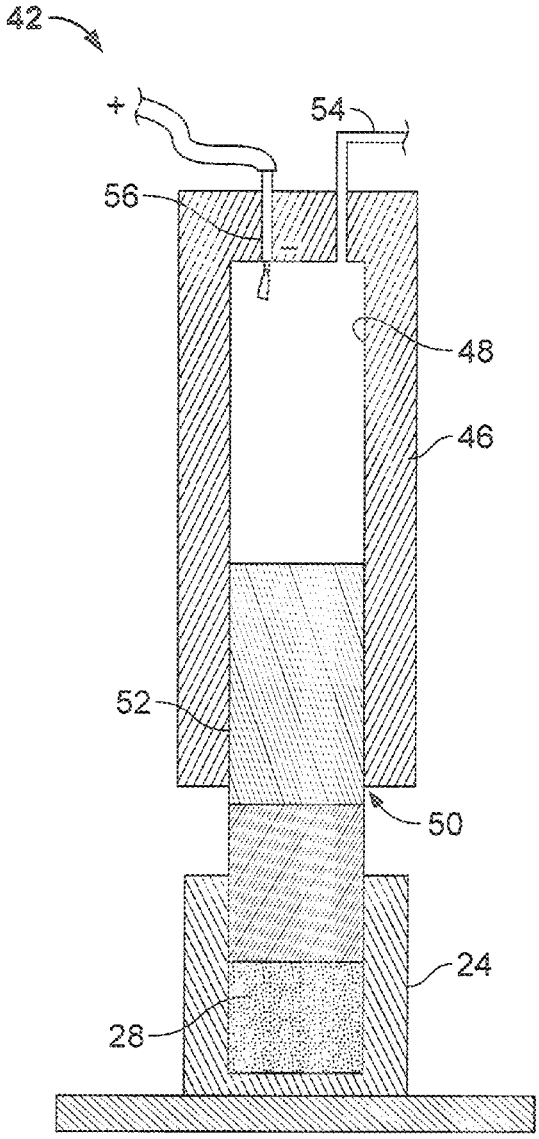
FIG. 4A illustrates a combustion driven compaction process.

FIG. 4A illustrates a combustion driven compaction process which may be utilized to compact the ferromagnetic powder 28 in a container 26 according to number of variations of the invention. A combustion container 46 may be provided having a combustion chamber 48 defined therein, in which a movable part or piston 52 may be received and moved through an open end 50 of the combustion container 46. A fuel inlet 50 may be operatively connected to inject fuel (and an oxidant such as air) into the chamber. An ignition source 56 may be provided to ignite the fuel causing the moving part or piston 52 to apply pressure to the powder 28 to compact the same.

Figure 4B:
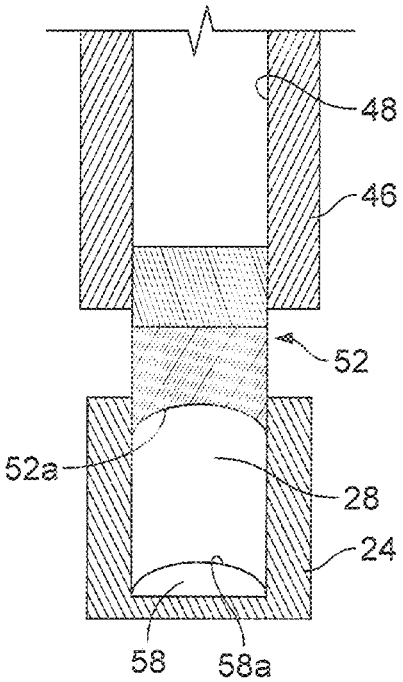
FIG. 4B is another illustration of a combustion driven compaction process using a die tool having a non-planar surface according to a number of variations.

As shown in FIG. 4B, the components of the combustion driven compaction process may be modified to provide at least one die tool 58 which may be received in the container 24 or may be apart thereof. The die tool 58 may have a curved or arcuate surface 58*a*. The moving part or piston 52 may have a curved or arcuate shaped surface 52*a* positioned to engage the powder 28. As shown in FIG. 4B the surface 58*a* of the the tool 58 is convex in cross section and the surface 52*a* of the moving part or piston 52 is convex in cross section. Alternatively, the configuration of surfaces 58*a* and 52*a* may be reversed, or only one of the surfaces 58*a* or 52*a* may be non-planar. The use of such a process produces magnets with curved surfaces which are particularly for use in electric motors. In this arrangement, the powder 28 may be aligned in a direction generally parallel with the radius of the curved surfaces produced by the compaction process. Alternatively, the compacted product may be magnetically aligned in a direction generally parallel to the radius of the curved surfaces of the compacted product.

Figure 5A:
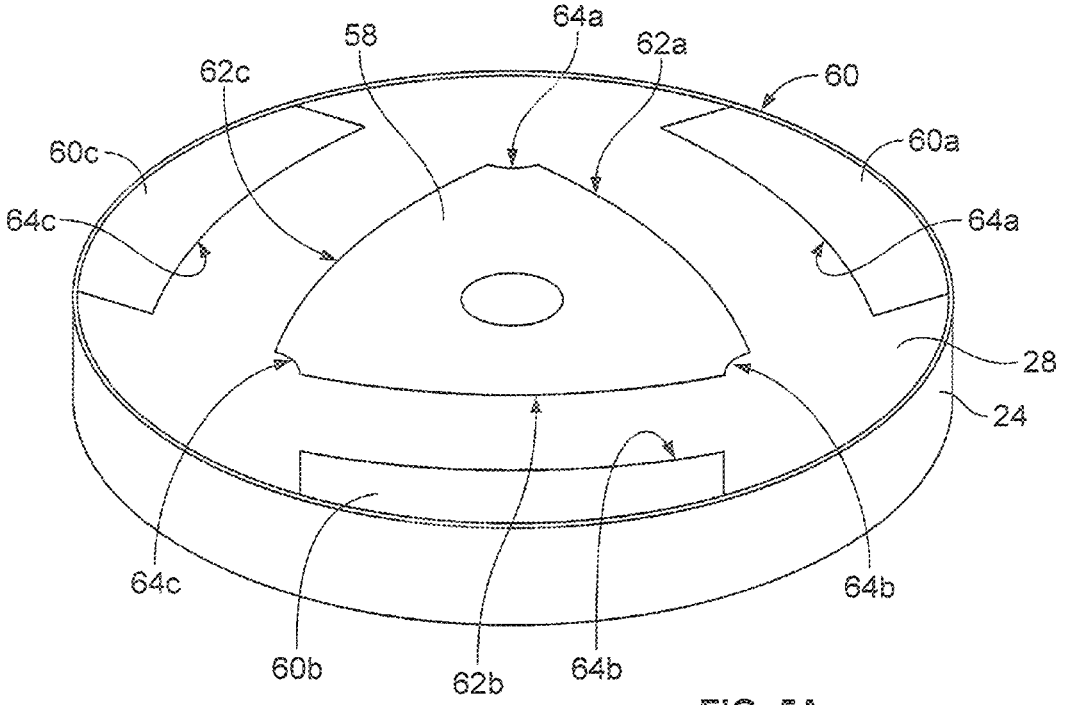
FIG. 5A is a perspective view of a product including at least one die tool useful in making a magnet including a non-planar surface according to a number of variations.

Referring now to FIG. 5A, a product may be provided which may include a container 24, which may be electrically conductive and may constitute a cylindrical ring. At least a first die tool 58 may be provided and pieced, for example, in the center of the container 24. A second die tool 60 may be provided and in a number of variations may include three spaced apart components 60*a*, 60*b*, and 60*c*. The first die component 58 may have a first curved edge or face 62*a* spaced apart from an opposite spaced apart curved edge or face 64*a* of component 60*a*. The first die tool 58 may have a second curved edge or face 62*b* spaced from an opposite spaced apart curved edge or face 64*b* of the second components 60*b*. The first die tool 58 may have a third curved edge or face 62*c* an opposite spaced apart curved edge or face 64*c* of the third component 60*c* of the second die tool 60. In a number of variations of the invention the curved edges or faces 62*a*, 62*b*, and 62*c* may have a convex shape. In a number of variations, the curved edges or faces 64*a*, 64*b*, 64*c* may each have a concave shape. The first die product 58 may include a first concave surface 64*a*, second concave surface 64*b*, and third concave surface 64*c* generally positioned at the corners of the first die tool 58.

Figure 5B:
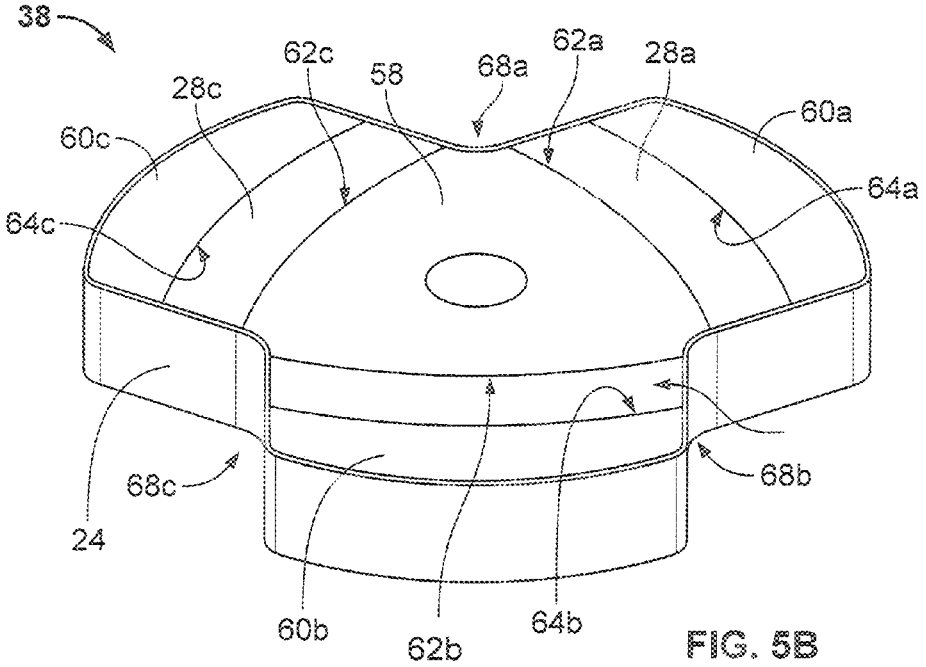
FIG. 5B is a perspective view of the resulting product of subjecting the product shown in FIG. 5A to a dynamic magnetic compaction process according to a number of variations.
Figure 6A:
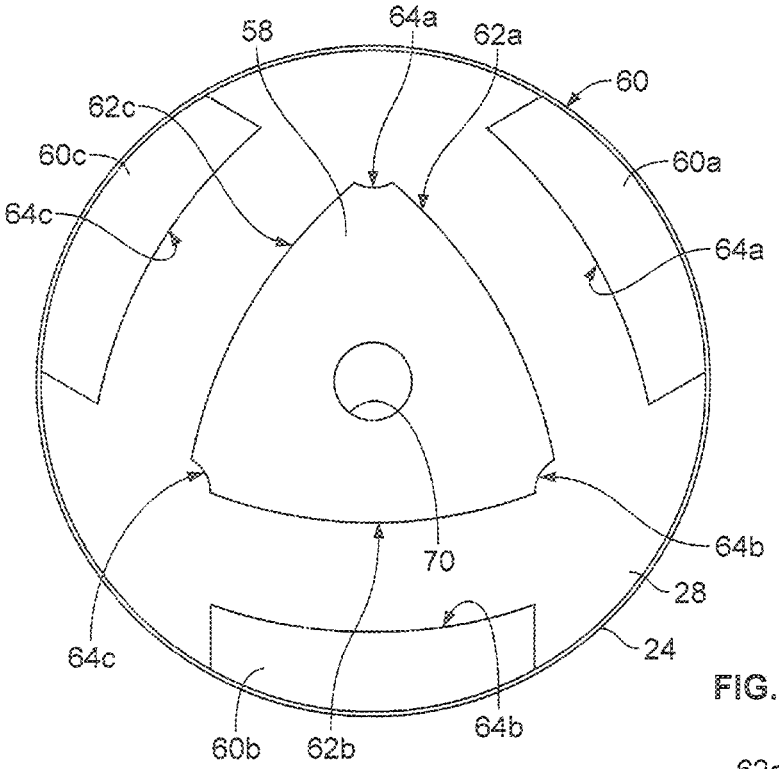
FIG. 6A is a plan view of the product shown in FIG. 5A.
Figure 6B:
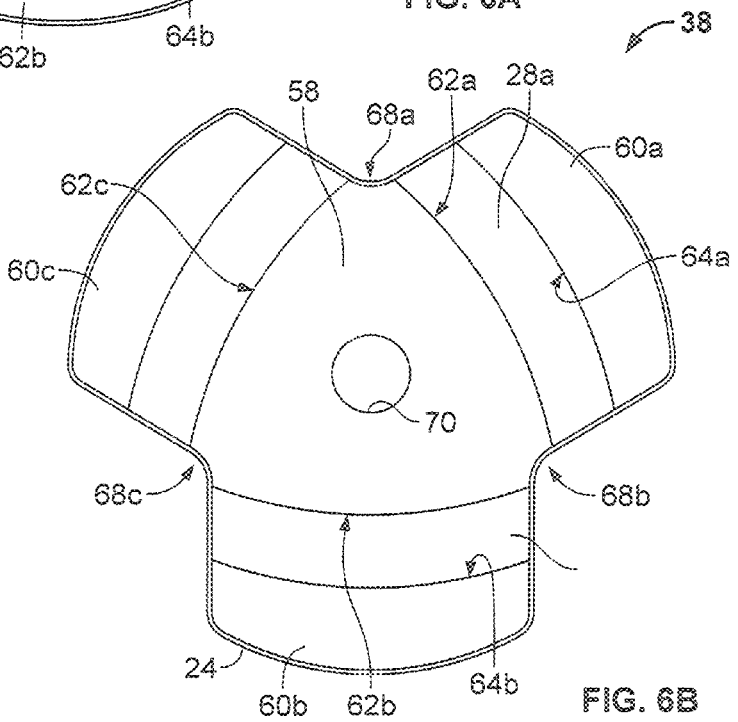
FIG. 6B is a plan view of the product shown in FIG. 5B.

FIG. 5B illustrates the resultant product when the product illustrating in 5A is subject to a dynamic magnetic compaction process. During the process the container 24 is collapsed until the container 24 engages the first the tool 58 thereby forming a first indent 68*a*, second indent 68*b* and third indent 68*c*. The powder 28 is moved during the process resulting in three arcuate shaped compacted powder portions 28*a*, 28*b*, and 28*c* which may be sintered into magnets particularly useful for electric motors. FIG. 6A is a plan view of the product shown in FIG. 5A, and FIG. 6B is a plan view of the product shown in FIG. 5B.

Figure 7A:
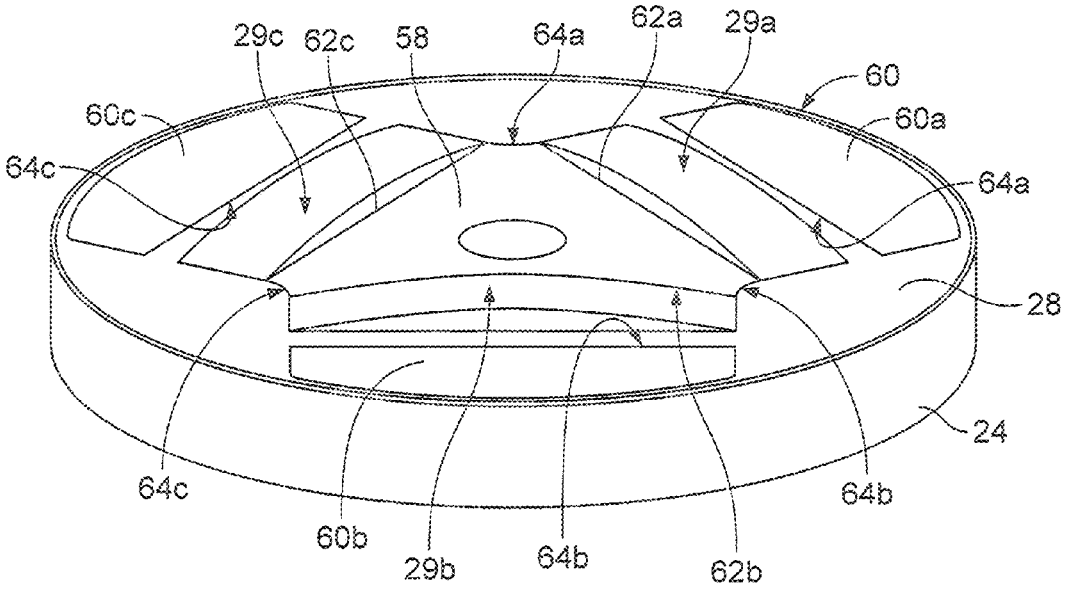
FIG. 7A is a perspective view of a product including at least one die tool having a straight edge or planar face, and molded powder having a portion with a non-planar surface or curved surface for use in a dynamic magnetic compaction process.
Figure 7B:
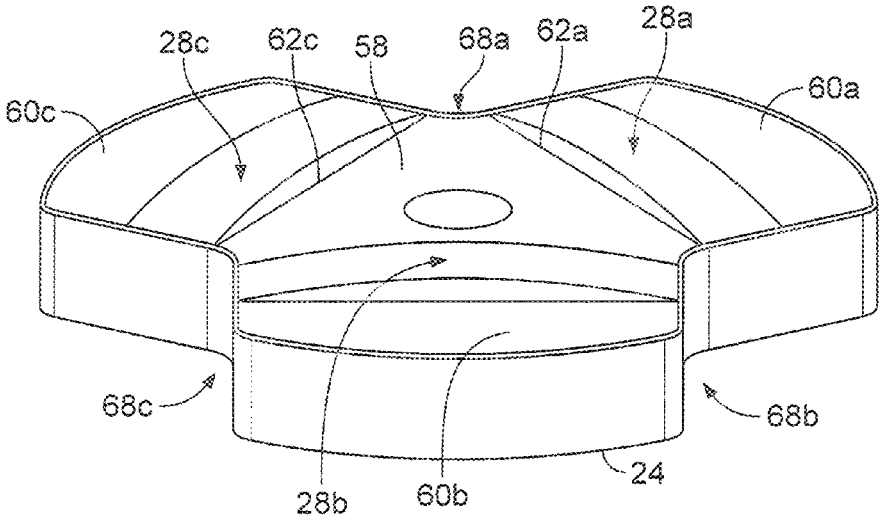
FIG. 7B is a perspective view of the product of FIG. 7A after being subjected to a dynamic magnetic compaction process.

Referring now to FIG. 7A, in a number of variations, the first die tool 58 may have a first side edge or face 62*a*, second side edge or face 62*b*, third side edge or face 62*c* which are straight or planar. The first component 60*a* of the second die tool 60 may include an edge or face 64*a* which is straight or planar, which may be spaced from and opposite the edge or face 62*a*. The second component 60*b* may include an edge or face 64*b* that is straight or planar, which may be spaced from and opposite the edge or face 62*b*. The third component 60*c* may include an edge or face 64*c* which is straight or planar, which may be spaced from and opposite edge or face 62*c*. The powder 28 may include a first raised portion 29*a* positioned between the first component 60*a* and the first die tool 58 and may include an arcuate shape surface having a radius parallel to the axis of the cylindrical ring shaped container 24. The powder may include a second raised portion 29*b* positioned between the second component 60*b* and the first die tool 58 and may include an arcuate surface having a radius parallel with the axis of the cylindrical ring shaped container 24. The powder may also include a third raised portion 29*c* positioned between the third component 60*c* and the first die tool 58. The third raised portion 39*c* may have an arcuate shaped surface having a radius parallel with the axis of the cylindrical ring shaped container 24. When the product illustrated in FIG. 7A is subject to a dynamic magnetic compaction process the resulting product may appear as illustrated in FIG. 7B. The product includes three compacted powder portions 28*a*, 28*b*, and 28*c*. The compacted powder portions 28*a*, 28*b*, and 28*c* may each include an arcuate surface having a radius parallel to the axis of the cylindrical ring shaped container 24 prior to compaction.

Figure 8:
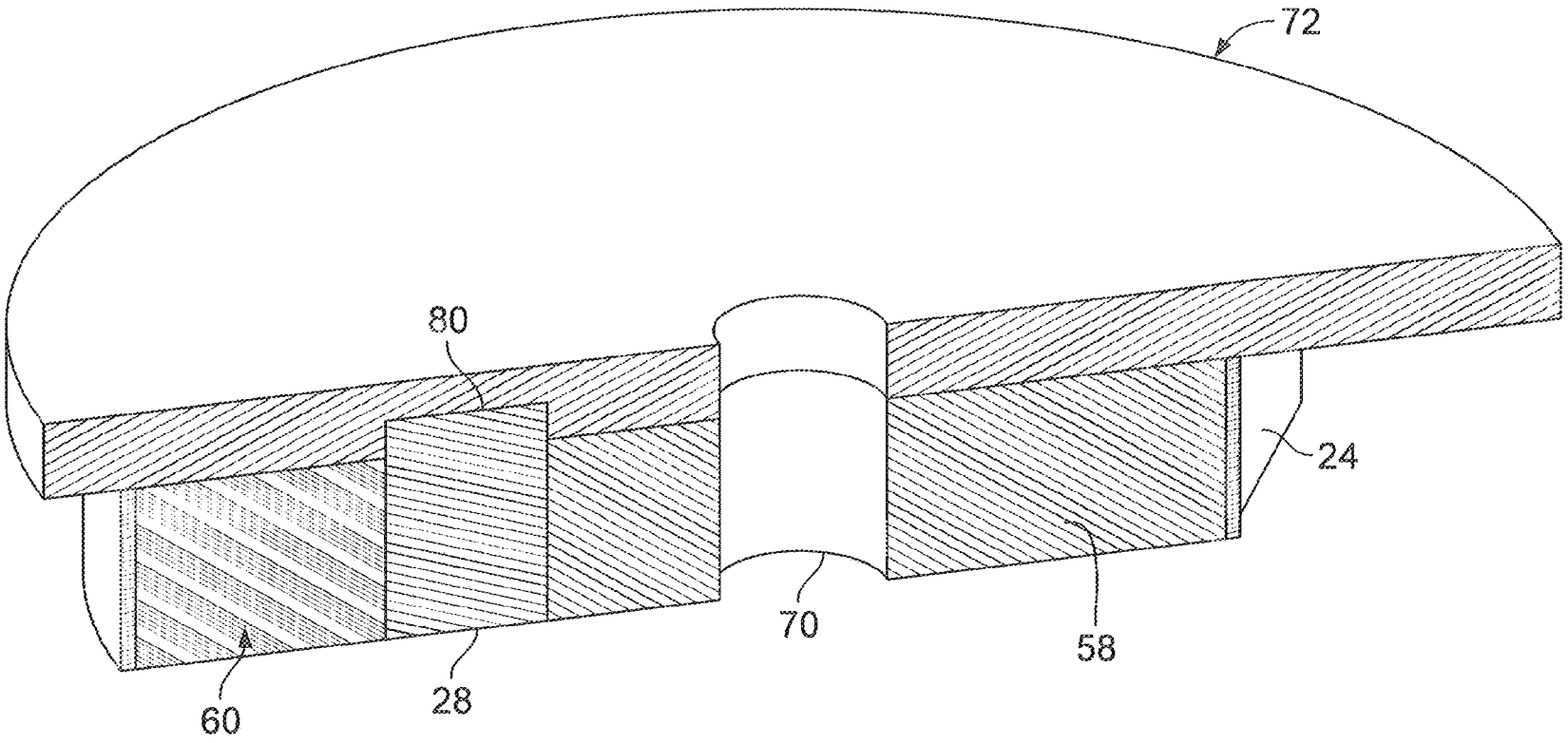
FIG. 8 is a sectional view of a product including a mold having a recess formed therein for forming the non-planar or curved surface of the molded powder shown in FIG. 7A.

FIG. 8 illustrates a method which may include providing a mold 72 having an arcuate recess 80 formed therein for producing one of the raised portions 29*a*, 29*b*, or 29*c*.

Figure 9A:
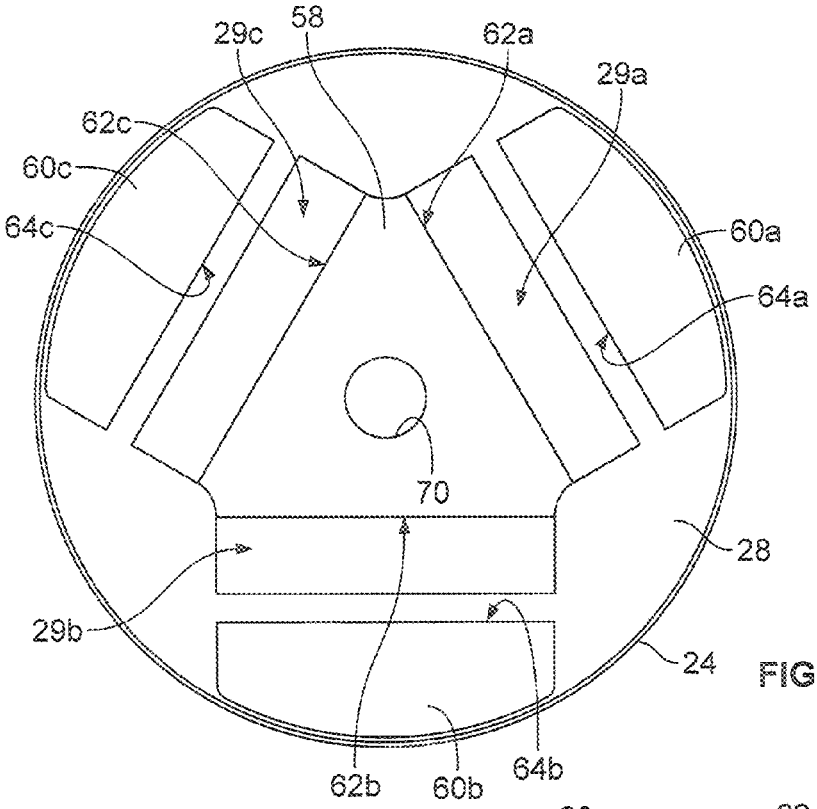
FIG. 9A is a plan view of the product shown in FIG. 7A.
Figure 9B:
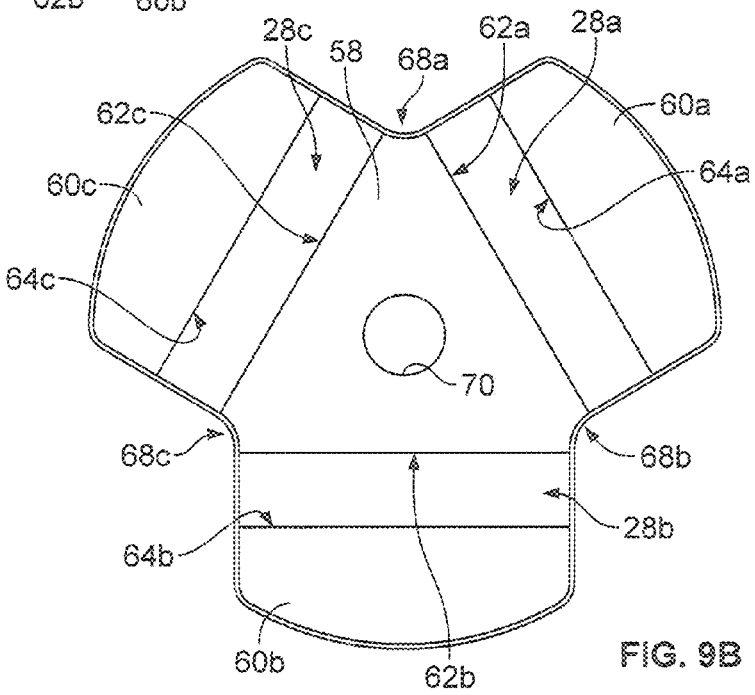
FIG. 9B is a plan view of the product shown in FIG. 7B.

FIG. 9A is a plan view of the product illustrated in FIG. 7A. FIG. 9B is a plan view of the product illustrated in FIG. 7B.

Figure 10:
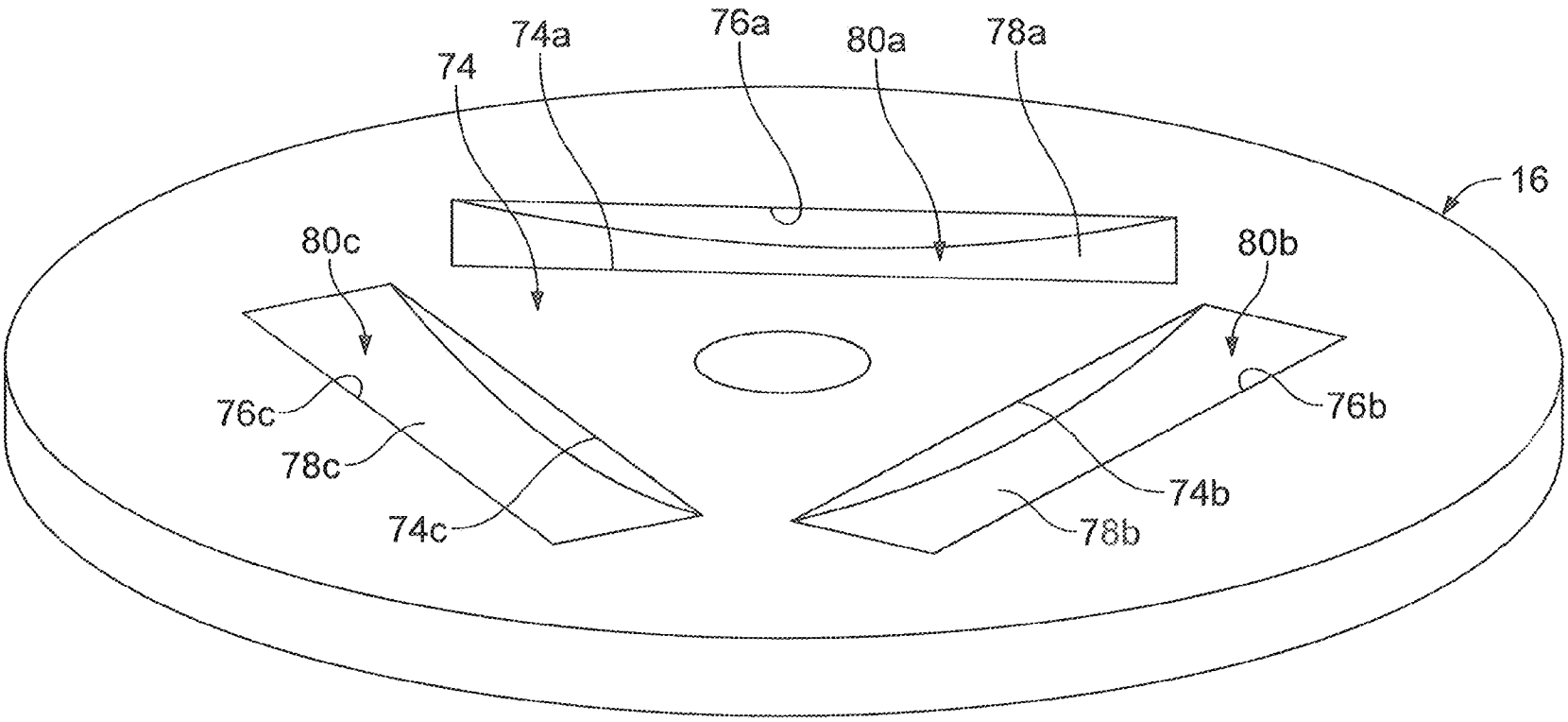
FIG. 10 is perspective view of a mold which may be used to form the non-planar or curved surfaces of the pressed powder shown in FIG. 7A.

FIG. 10 is a plan view of one face of the mold 72 shown in FIG. 8. The raised portions 29*a*, 29*b* and 29*c* of the powder may be formed by pressing powder into the recesses 80*a*, 80*b*, and 80*c* respectively. The first recess 80*a* may be defined by an arcuate shaped surface 78*a* and two parallel spaced apart side walls 74*a* and 76*a*. Similarly, a second recess 80*b* may be defined by an arcuate shaped surface 78*b* and two parallel spaced apart side wails 74*b* and 76*b*. A third recess 80*c* may be defined by an arcuate shaped surface 78*c* and two parallel spaced apart side walls 74*c* and 76*c* joining the same. The arcuate shaped surfaces 78*a*, 78*b* and 78*c* are generally concaved in profiled. If desired, a second mold portion may be provided which is the inverse mirror image of that shown in FIG. 10, which would provide a first, second and third raised portions each having arcuate shaped surfaces and may be placed on the opposite from that of the first mold 72 side, of the first die tool 58 and second die tool 60. Such molds would produce arcuate shaped magnets having an inner concave surface and an outer convex surface which would be particularly suitable for use in electric motors. The powder or compacted product may be magnetically aligned in a direction generally parallel with the radius of the arc shaped molded powder or compacted powder product.

Dynamic compaction process may be utilized in making magnets with at least one surface with non-flat arc shape as well as magnets of single or multiple powder formulations (or gradient compositions) resulting in desirable magnetic flux levels at desired location based on the stator or rotor design. Magnetic alignment may be achieved by use of a special magnetic field to substantially align the powder particles prior to dynamic compaction step as a two-step process. Use of pre-aligned powder may be compacted dynamically to higher pressures (>827 MPa). The magnets formed this way could later be sintered under protective atmosphere, if necessary. In one variation the exterior powder may include a protective material such as Ni based alloy powder so that traditional coating processing steps could be eliminated. In another variation the outer layer prior to Ni powder may be that of dysprosium containing alloy or compound, if desired. The powder formulations could be filled selectively in the die in multiple layers or in various regions. If necessary one of the layers or regions could be a different permanent magnet material composition to meet design needs or to reduce the amount of use of expensive rare earth materials. Following the dynamic compaction, the magnetic material may be coated and sintered and machined as desired. If the magnets do not have a protective surface layer (such as Ni or rare earth containing alloy or compound), there may be loss of rare earth elements (especially heavy rare earth elements) during vacuum sintering or heat treatment. In another variation using non sacrificial hard tooling magnets with tapered profiles can be made. Use of profiled hard tooling as a part of the top core rod and or stop, may enable making of multiple arc shaped magnets with rectangular walls of desired shape and length. The dynamic compaction may be combustion driven compaction process or a magnetic compaction process. In case of CDC, the powder may be, in select variations, aligned using appropriate magnetic field while the powder is in the die or before it is placed in the die as a prealigned green compact, prior to dynamic compaction.

Any coating for magnet green parts that involves a liquid or slurry may be too volatile to put into the sintering vacuum furnace. The compacted products may be coated before sintering to prevent the loss of surface elements such as Dy and other RE. Suitable coatings may include compound powders with organic solvent as binder and may be applied via spray (to a thickness of 10-500 microns). The compound powder may be a mixture of several substances. The substances do not either react with the rare earth elements in the compacted products or magnets during sintering, or may release the rare earth elements into the magnets through solid diffusion. The compound coating may be a temporary coating that may be blasted off after sintering and heat treatment, or a permanent oxidizing protective coating that will not be removed after sintering. The compound may include aluminum oxide, dysprosium sulfide etc.

A number of variations may include a method including preparing a slurry comprising a mixture of ceramic and mineral particles suspended in an aqueous or organic based (e.g., ethanol, acetone) solution of sodium silicate. For example, the mixture comprising by weight about 55% to about 65% silica oxide, about 25% to about 35% magnesia, about 2% to about 8% kaolin, and about 2% to about 8% montmorillonite. The solution comprise about 20% to about 40% by weight dissolved sodium silicate having a silica to sodium oxide molar ratio between about 2.5 and 3.8. The slurry comprises by weight about 40 to 48 parts of said solution. The organic solvent may easily evaporate.

The following description of variants is only illustrative of components, elements, acts, product and methods considered to be within the scope of the invention and are not in any way intended to limit such scope by what is specifically disclosed or not expressly set forth. The components, elements, acts, product and methods as described herein may be combined and rearranged other than as expressly described herein and still are considered to be within the scope of the invention.

Variation 1 may include a method including: providing a first powder comprising iron; compacting the first powder into a compacted powder product having a non-planar surface, wherein the compacting comprises dynamic magnetic compaction or combustion driven compaction; increasing the magnetic coercivity of at least one of the first powder or the compacted powder product.

Variation 2 may include a method as set forth in Variation 1 wherein the first powder is magnetically aligned.

Variation 3 may include a method as set forth in Variation 1 further comprising magnetically aligning the first powder.

Variation 4 may include a method as set forth in Variation 1 further comprising magnetically aligning the compacted powder product.

Variation 5 may include a method as set forth in any of Variations 1-4 wherein increasing the magnetic coercivity of at least one of the first powder or the compacted powder product comprises adding a material comprising Dy to at least one of the first powder or the compacted powder product.

Variation 6 may include a method as set forth in Variation 5 further comprising diffusing Dy in the compacted powder product.

Variation 7 may include a method as set forth in Variation 6 wherein diffusing Dy in the compacted powder product comprises heat treating the at least the compacted powder product to diffuse Dy therein.

Variation 8 may include a method as set forth in any one of Variations 1-5 wherein increasing the magnetic coercivity of at least one of the first powder or the compacted powder product comprises depositing a material comprising Dy onto the compacted powder product.

Variation 9 may include a method as set forth in Variation 8 wherein the depositing comprises chemical vapor deposition.

Variation 10 may include a method as set forth in any of Variations 1-9 further comprising sintering the compacted powder product to provide a sintered product.

Variation 11 may include a method as set forth in Variation 10 further comprising diffusing Dy into the sintered product.

Variation 12 may include a method as set forth in any one of Variations 1-11.

Variation 13 may include a method as set forth in any one of Variations 1-12 wherein the compacted powder product includes a convex face and an opposite concave face.

Variation 14 may include a method as set forth in any one of Variations 1-13 wherein the compacting comprises dynamic magnetic compaction.

Variation 15 may include a method as set forth in Variation 14 and wherein the non-planar surface is has an arcuate shape, wherein the compacting further comprises providing an electrically conductive cylindrical ring, a first die tool in the ring, the first die tool having an arcuate shaped face, and wherein the first powder in positioned in the ring against the arcuate shaped face of the first tool die, and wherein the compacting causes the ring to collapse and the powder to be compacted against the arcuate shaped face of the first tool die.

Variation 16 may include a method as set forth in Variation 15 wherein the compacting further comprise providing a second die tool in the ring, the second die tool having an arcuate shaped face, and wherein the arcuate face of the first tool die and the arcuate shaped face of the second die tool are positioned opposite each other in a spaced apart relationship and so that the compacting produces a compacted product having first and second arcuate faces.

Variation 17 may include a method as set forth in Variation 14 and wherein the non-planar surface is has an arcuate shape, wherein the compacting further comprises providing a mold having a recess defined therein by an arcuate shaped surface and opposed side walls, an electrically conductive cylindrical ring, a first die tool in the ring, the first die tool having a planar shaped face, wherein the mold is positioned under the ring and wherein the first powder in positioned in the ring against the planar shaped face of the first tool die and so that the powder includes a raised portion in the recess in the mold, and wherein the compacting causes the ring to collapse and the powder to be compacted against the planar shaped face of the first tool die.

Variation 18 may include a method as set forth in Variation 17 wherein the compacting further comprise providing a second die tool in the ring, the second die tool having an planar face, and wherein the planar face of the first tool die and the planar shaped face of the second die tool are positioned opposite each other in a spaced apart relationship and so that the compacting produces a compacted product having at least one arcuate shaped face.

Variation 19 may include a method as set forth in any of Variation 1-18 wherein the non-planar surface has an arcuate shape and wherein the compacting comprises combustion driven compaction comprising providing a container for holding the first powder and a piston, and wherein at least one of the container or piston includes an arcuate shaped surface constructed and arranged to produce the arcuate shaped face of the compacted powder product.

Variation 20 may include a method including: providing a first powder comprising iron and Dy; compacting the first powder into a compacted powder product having a non-planar surface, wherein the compacting comprises dynamic magnetic compaction or combustion driven compaction.

Variation 21 may include a method as set forth in Variation 20 further comprising diffusing the Dy in the compacted powder.

Variation 22 may include a method as set forth in Variation 21 wherein diffusing the Dy in the compacted powder product comprises heat treating the compacted powder product.

Variation 23 may include a method as set forth in any one of Variations 20-22 further comprising sintering the compacted powder product.

The above description of select examples of the invention is merely exemplary in nature and, thus, variations or variants thereof are not to be regarded as a departure from the spirit and scope of the invention.

What is claimed is:

1. A method comprising:

providing a first powder comprising iron;

compacting the first powder into a compacted powder product having a non-planar surface, wherein the compacting comprises dynamic magnetic compaction;

increasing the magnetic coercivity of at least one of the first powder or the compacted powder product; and wherein the non-planar surface has an arcuate shape, wherein the compacting further comprises providing a mold having a recess defined therein by an arcuate shaped surface and opposed side walls, a first die tool in a ring, the first die tool having a planar shaped face, wherein the mold is positioned under the ring and wherein the first powder is positioned in the ring against the planar shaped face of the first tool die and so that the powder includes a raised portion in the recess in the mold, and wherein the compacting causes the ring to collapse and the powder to be compacted against the planar shaped face of the first tool die.

2. A method as set forth in claim 1 further comprising magnetically aligning the first powder.

3. A method as set forth in claim 1 further comprising magnetically aligning the compacted powder product.

4. A method as set forth in claim 1 further comprising diffusing Dy in the compacted powder product.

5. A method as set forth in claim 4 wherein diffusing Dy in the compacted powder product comprises heat treating the compacted powder product to diffuse Dy therein.

6. A method as set forth in claim 1 wherein increasing the magnetic coercivity of at least one of the first powder or the compacted powder product comprises depositing a material comprising Dy onto the compacted powder product.

7. A method as set forth in claim 6 wherein the depositing comprises chemical vapor deposition.

8. A method as set forth in claim 1 further comprising sintering the compacted powder product to provide a sintered product.

9. A method as set forth in claim 8 further comprising diffusing Dy into the sintered product.

10. A method as set forth in claim 1 wherein the compacting further comprise providing a second die tool in the ring, the second die tool having an planar face, and wherein the planar face of the first tool die and the planar shaped face of the second die tool are positioned opposite each other in a spaced apart relationship and so that the compacting produces a compacted product having at least one arcuate shaped face.

11. A method comprising:

providing a first powder comprising iron;

magnetically aligning the first powder;

compacting the first powder into a compacted powder product having a non-planar surface having an arcuate shape, wherein the compacting comprises dynamic magnetic compaction;

increasing the magnetic coercivity of at least one of the first powder or the compacted powder product by adding a material comprising Dy to at least one of the first powder or the compacted powder product by diffusing Dy into the compacted powder product and further comprising heat treating the compacted powder product;

and wherein the non-planar surface has an arcuate shape, and wherein the compacting further comprises providing a mold having a recess defined therein by an arcuate shaped surface and opposed side walls, a first die tool in a ring, the first die tool having a planar shaped face, wherein the mold is positioned under the ring and wherein the first powder is positioned in the ring against the planar shaped face of the first tool die and so that the powder includes a raised portion in the recess in the mold, and wherein the compacting causes the ring to collapse and the powder to be compacted against the planar shaped face of the first tool die.

* * * * *